US008733896B2

(12) United States Patent
Dowell et al.

(10) Patent No.: US 8,733,896 B2
(45) Date of Patent: May 27, 2014

(54) MANIFOLD ASSEMBLY FOR FLUID-EJECTION DEVICE

(75) Inventors: Daniel D. Dowell, Albany, OR (US); Joseph R. Elliot, Corvallis, OR (US); Judson M. Leiser, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 13/825,030

(22) PCT Filed: Nov. 30, 2010

(86) PCT No.: PCT/US2010/058408

§ 371 (c)(1), (2), (4) Date: Mar. 19, 2013

(87) PCT Pub. No.: WO2012/074514

PCT Pub. Date: Jun. 7, 2012

(65) Prior Publication Data

US 2013/0201255 A1 Aug. 8, 2013

(51) Int. Cl.
*B41J 2/14* (2006.01)
*B41J 2/16* (2006.01)

(52) U.S. Cl.
USPC ..... 347/44; 347/42; 347/85

(58) Field of Classification Search
CPC ..... B41J 2/145; B41J 2/155
USPC ..... 347/20–21, 40, 42–44, 65, 71, 84–85
See application file for complete search history.

(56) References Cited

U.S. PATENT DOCUMENTS

| | | | | |
|---|---|---|---|---|
| 4,883,219 | A * | 11/1989 | Anderson et al. | 228/190 |
| 6,250,738 | B1 | 6/2001 | Waller et al. | |
| 6,435,652 | B1 | 8/2002 | Rezanka | |
| 7,226,156 | B2 | 6/2007 | Boyd et al. | |
| 2002/0101487 | A1 | 8/2002 | Petersen et al. | |
| 2004/0113998 | A1 | 6/2004 | Silverbrook | |
| 2007/0046739 | A1 | 3/2007 | Lee et al. | |
| 2008/0309743 | A1 | 12/2008 | Nikkel et al. | |
| 2009/0002422 | A1 | 1/2009 | Stephenson, III | |

* cited by examiner

*Primary Examiner* — Thinh Nguyen

(57) ABSTRACT

A manifold assembly for a fluid-ejection device having multiple-fluid type fluid-ejection printheads organized in a page-wide array includes a lower-most deck and an upper-most deck. The lower-most deck is to supply a first type of fluid and a second type of fluid to the fluid-ejection printheads. The first type of fluid and the second type of fluid are exterior-most fluids ejected by the fluid-ejection printheads in relation to a direction of media movement through the fluid-ejection device. The upper-most deck is to supply a third type of fluid and a fourth type of fluid to the fluid-ejection printheads. The third type of fluid and the fourth type of fluid are interior-most fluids ejected by the fluid-ejection printheads in relation to the direction of media movement through the fluid ejection device.

15 Claims, 8 Drawing Sheets

MANIFOLD ASSEMBLY FOR FLUID-EJECTION DEVICE

BACKGROUND

Fluid-ejection devices eject fluid in desired patterns onto media. For example, fluid-ejection devices include inkjet-printing devices that eject ink onto media like paper to form desired images on the media. Some types of fluid-ejection devices employ moving or scanning fluid-ejection printheads, which eject fluid onto a swath of media as the printheads move back and forth across the swath while the media is temporarily stationary. Other types of fluid-ejection devices employ stationary fluid-ejection printheads, which eject fluid onto media as the media is moved past the printheads. These latter types of fluid-ejection devices are commonly referred to as page-wide array fluid-ejection devices.

DETAILED DESCRIPTION

Figure 1:
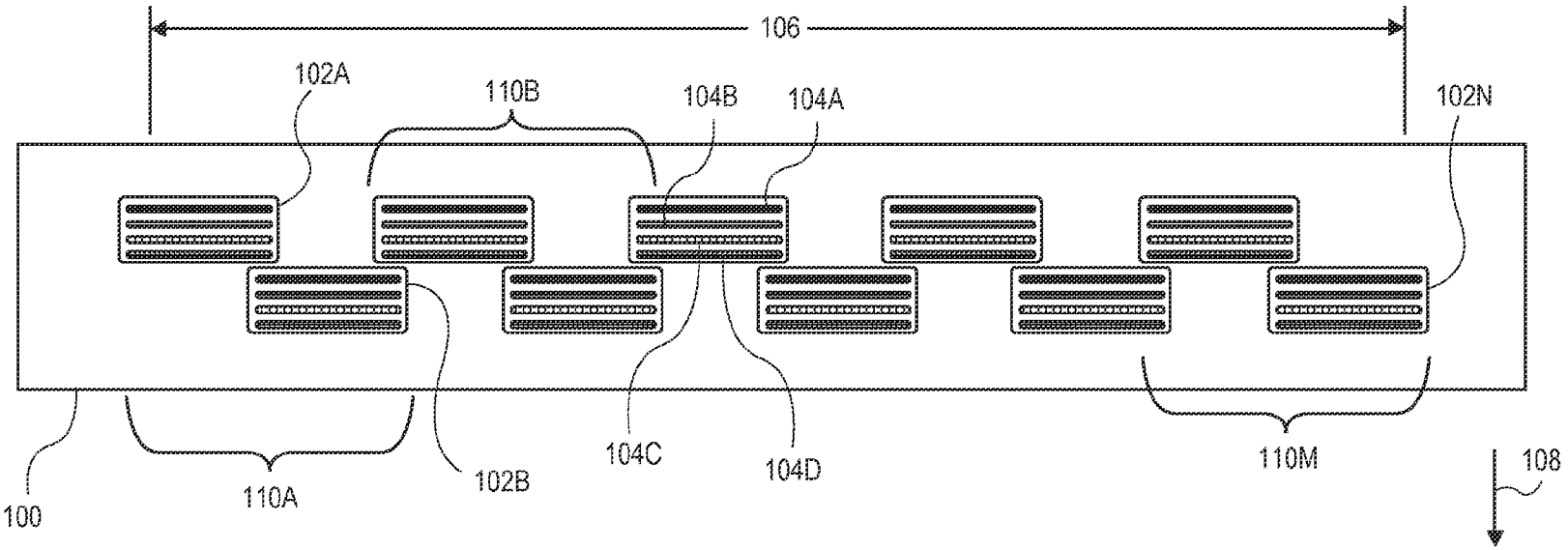
FIG. 1 is a diagram of a portion of a page-wide array fluid-ejection device, according to an embodiment of the disclosure.

As noted in the background section, one type of fluid-ejection device is known as a page-wide array fluid-ejection device, which employs stationary fluid-ejection printheads that eject fluid onto media as the media is moved past the printheads. The fluid-ejection printheads are organized in an array along the width of the media on which fluid is to be ejected. As the media moves past the fluid-ejection printheads, the printheads selectively eject fluid onto the media in a desired pattern. The fluid-ejection printheads may have multiple fluid types, such as different colored fluid or ink so that full-color images can be formed or printed on media like paper.

A fluid-ejection device that has multiple-fluid type fluid-ejection printheads organized in a page-wide array is susceptible to a number of different problems associated with supplying multiple types of fluid to the printheads for ejection by the printheads. First, for optimal fluid ejection, the mechanism within the fluid-ejection device that moves the media past the fluid-ejection printheads is desirably located close to the area within the device at which the printheads eject fluid onto the media. However, this limits the space available for supplying the multiple types of fluid to the printheads. Second, supplying fluid to the fluid-ejection printheads can impair optimal ejection of the fluid by the printheads if fluidic pressures are not balanced.

Third, if fluid is supplied to the fluid-ejection printheads within a small cross-sectional area as compared to the cross-sectional area of each printhead itself, fluidic pressure spikes can result that also impair optimal fluid ejection by the printheads. Fourth, if air or other gases become trapped while fluid is being supplied to the fluid-ejection printheads, optimal fluid ejection by the printheads is further impaired, and can decrease the operating life of the printheads. Fifth, ejecting fluid like pigmented ink can result in solid parts of the fluid collecting at various places while fluid is being supplied to the fluid-ejection printheads, which can also impair optimal fluid ejection by the printheads and decrease the operating life of the printheads.

Embodiments of a manifold assembly for supplying fluid to a fluid-ejection device are disclosed herein that address these problems. The manifold assembly includes a lower-most deck to supply two types of fluid, such as two differently colored inks, to the fluid-ejection printheads, and an upper-most deck to supply two other types of fluid, such as two other differently colored inks, to the printheads. This multiple-deck strategy can ensure that the manifold assembly fits into a small allotted space for supplying the multiple types of fluid to the printheads.

The multiple decks of the manifold assembly can in one embodiment be logically divided into multiple modules organized along a direction perpendicular to the direction of media movement through the fluid-ejection device, where each module supplies the multiple types of fluid to a pair of the fluid-ejection printheads. By designing a reference module so that fluidic pressures are balanced therein, a manifold assembly of a desired length can be fabricated by simply replicating the reference module as dictated by the number of fluid-ejection printhead pairs. As such, manifold assemblies of different sizes can be easily designed once a module has been suitably designed.

The multiple decks of the manifold assembly can in one embodiment include channels having lengths corresponding to the lengths of the fluid-ejection printheads, so that the multiple types of fluid are supplied across the lengths of the fluid-ejection printheads to decrease the potential for fluidic pressure spikes occurring. The multiple decks can also in one embodiment include channels and holes that each increase in size along at least one dimension in a direction away from the fluid-ejection printheads, to decrease the potential for entrapment of air or other gases within the manifold assembly. The multiple decks can further in one embodiment be designed so that the multiple types of fluid do not travel in a direction away from the fluid-ejection printheads, to decrease the potential for solid parts of the fluid from collecting within the manifold assembly.

FIG. 1 shows a portion of a page-wide array fluid-ejection device 100, according to an embodiment of the disclosure. The fluid-ejection device 100 includes fluid-ejection printheads 102A, 102B, . . . , 102N, collectively referred to as the fluid-ejection printheads 102. The fluid-ejection printheads 102 are organized in pairs 110A, 110B, . . . , 110M, collectively referred to as the pairs 110. The number of pairs 110 is thus equal to the number of fluid-ejection printheads 102, divided by two.

The fluid-ejection printheads 102 are organized in a page-wide array corresponding to a width 106 of media. As media is moved past the fluid-ejection printheads 102 in a direction 108, the printheads 102 eject fluid onto the media in a desired pattern. The printheads 102 are thus themselves stationary during the fluid-ejection process.

Each fluid-ejection printhead 102 ejects fluid of fluid types 104A, 104B, 104C, and 104D, collectively referred to as the fluid types 104. The fluid types 104 can correspond to different colors of fluid, such as different colors of ink, so that the fluid-ejection printheads 102 can form full-color images on media. The fluid types 104A and 104D are exterior-most types of fluid that are ejected by the fluid-ejection printheads 102 in relation to the direction 108, and the fluid types 104B and 104C are interior-most types of fluid that are ejected by the printheads 102 in relation to the direction 108.

That is, the fluid types 104A and 104D are ejected first and last, respectively, by the fluid-ejection printheads 102 by portions of the printheads 102 closest to their exteriors in relation to the direction 108. By comparison, the fluid types 104B and 104C are not ejected first or last by the fluid-ejection printheads 102, and are ejected by portions of the printheads 102 farthest from their exteriors (and thus closest to their interiors) in relation to the direction 108. This is what is meant by the fluid types 104A and 104D being exterior-most ejected fluids, and the fluid types 104B and 104C being interior-most ejected fluids.

Figure 2:
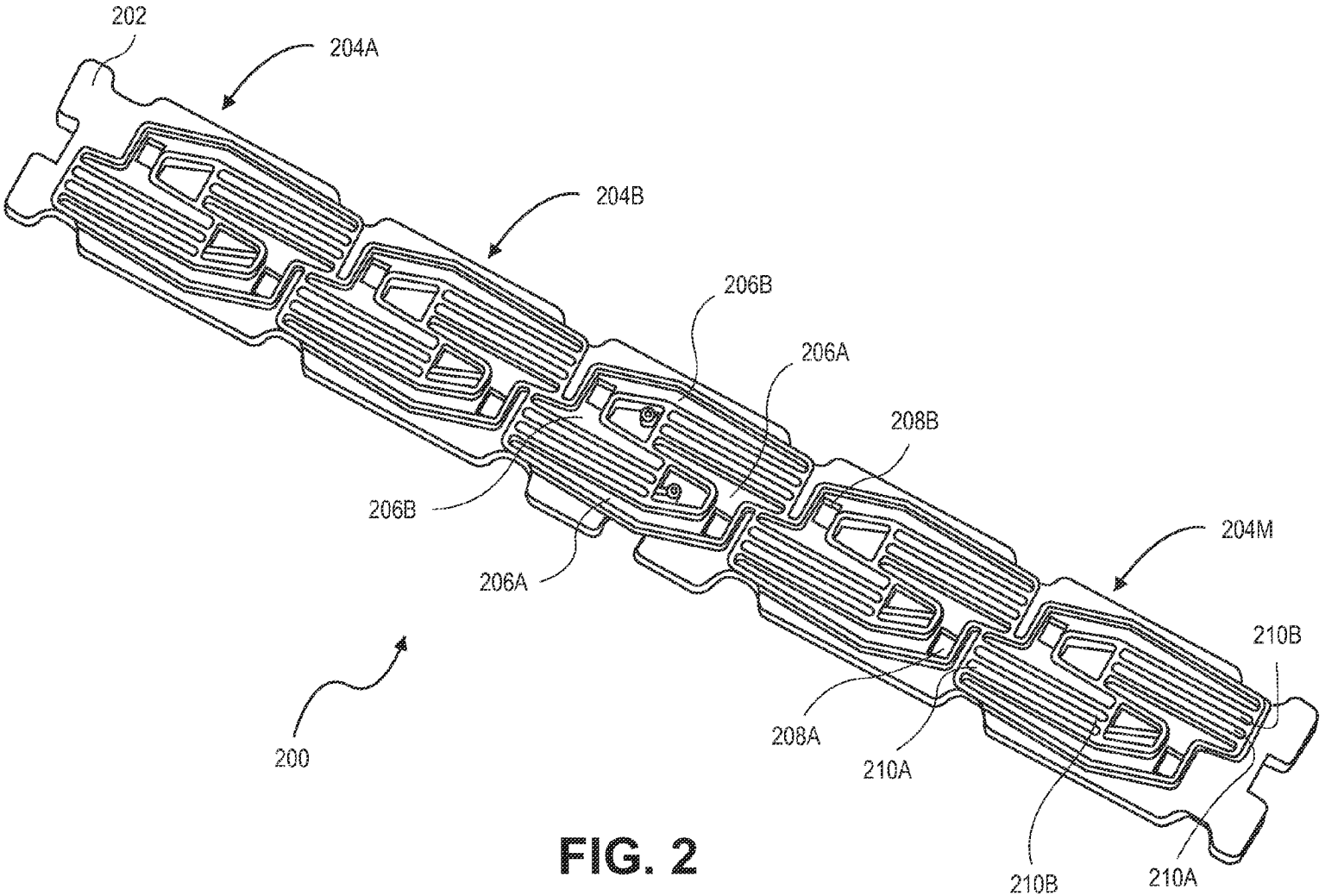
FIG. 2 is a diagram of a bottom side of a lower-most deck of a manifold assembly of a fluid-ejection device, according to an embodiment of the disclosure.

FIG. 2 shows a bottom side of a lower-most deck 202 of a manifold assembly 200 of the fluid-ejection device 100, according to an embodiment of the disclosure. The lower-most deck 202 is to supply the fluid type 104A and the fluid-type 104D to the fluid-ejection printheads 102. The lower-most deck 202 is logically divided into modules 204A, 204B, . . . , 204M, collectively referred to as the modules 204, and which correspond to the fluid-ejection printhead pairs 110. The modules 204 are identical to one another with respect to how the modules 204 deliver the fluid types 104A and 104D to the fluid-ejection printheads 102.

Each module 204 of the lower-most deck 202 includes channels 206A that have lengths corresponding to the lengths of the fluid-ejection printheads 102 to supply the fluid of type 104A to the printheads 102 of a corresponding pair 110. Each module 204 in this respect includes a hole 208A to receive the fluid type 104A through an upper-most deck of the manifold assembly 200. Each module 204 of the lower-most deck further includes channels 206B that have lengths corresponding to the lengths of the fluid-ejection printheads 102 to supply the fluid of type 104D to the fluid-ejection printheads 102. Each module 204 in this respect includes a hole 208B to receive the fluid type 104D through an upper-most deck of the manifold assembly 200. The channels 206A and 206B are collectively referred to as the channels 206, and the holes 208A and 208B are collectively referred to as the holes 208.

Each module 204 of the lower-most deck 202 also includes channels 210A through which an upper-most deck of the manifold assembly 200 is able to supply the fluid of type 104B to the fluid-ejection printheads 102 of a corresponding pair 110. Similarly, each module 204 of the lower-most deck 202 includes channels 210B through which an upper-most deck of the manifold assembly 200 is able to supply the fluid of type 104C to the fluid-ejection printheads 102 of a corresponding pair 110. The channels 210A and 210B are collectively referred to as the channels 210.

Figure 3:
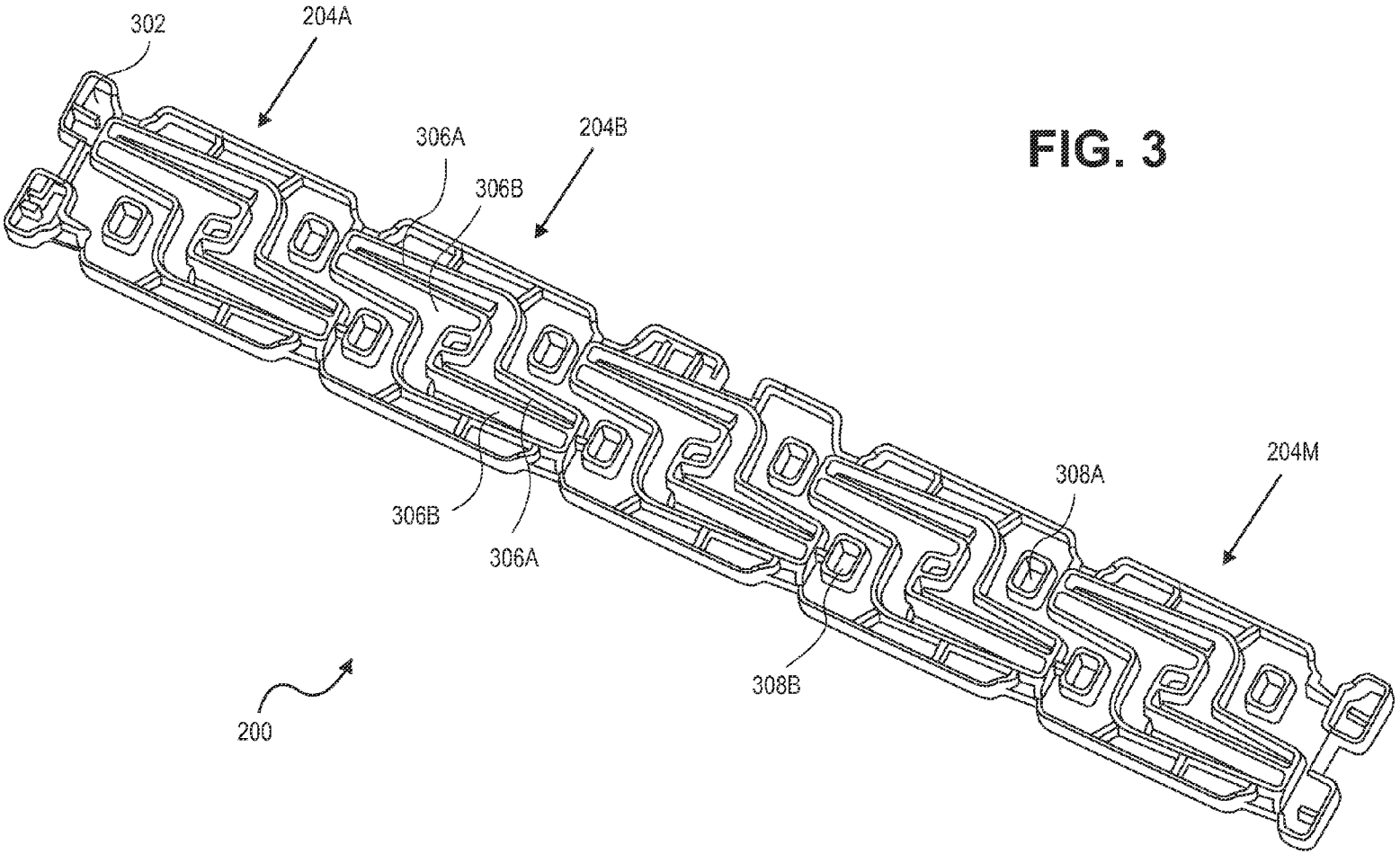
FIG. 3 is a diagram of a top side of an upper-most deck of a manifold assembly of a fluid-ejection device, according to an embodiment of the disclosure.

FIG. 3 shows a top side of an upper-most deck 302 of the manifold assembly 200 of the fluid-ejection device 100, according to an embodiment of the disclosure. The upper-most deck 302 is to supply the fluid type 104B and the fluid type 104C to the fluid-ejection printheads 102. The upper-most deck 302, like the lower-most deck 202, is logically divided into modules 204A, 204B, . . . , 204M, collectively referred to as the modules 204, and which correspond to the fluid-ejection printhead pairs 110. The modules 204 are identical to one another with respect to how the modules 204 deliver the fluid types 104B and 104C to the fluid-ejection printheads 102.

Each module 204 of the upper-most deck 302 includes channels 306A that have lengths corresponding to the lengths of the fluid-ejection printheads 102 to supply the fluid of type 104B to the printheads 102 of a corresponding pair 110 through the channels 210A of the lower-most deck 202. Each module 204 of the upper-most deck 302 further includes channels 306B that have lengths corresponding to the lengths of the fluid-ejection printheads 102 to supply the fluid of type 104C to the printheads 102 of a corresponding pair 110 through the channels 210B of the lower-most deck 202. The channels 306A and 306B are collectively referred to as the channels 306.

Each module 204 of the upper-most deck 302 also includes a hole 308A to provide the fluid type 104A to the lower-most deck 202 via the hole 208A of the lower-most deck 202. Each module 204 of the upper-most deck 302 further includes a hole 308B to provide the fluid type 104D to the lower-most deck 202 via the hole 208B of the lower-most deck 202. The holes 308A and 308B are collectively referred to as the holes 308.

Figure 4B:
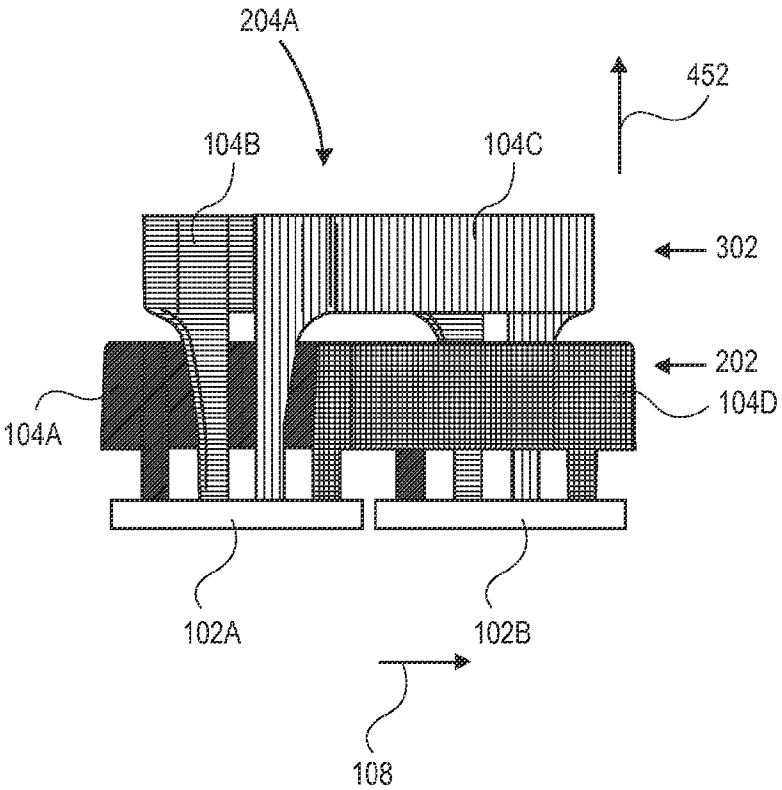
FIGS. 4A and 4B are diagrams depicting how a representative module of a lower-most deck and an upper-most deck of a manifold assembly supplies types of fluid to a pair of fluid-ejection printheads, according to an embodiment of the disclosure.
Figure 4A:
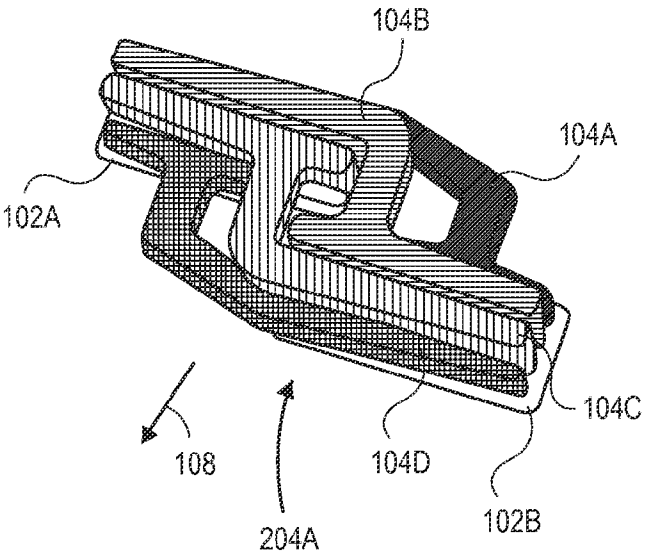

FIGS. 4A and 4B illustrate how a representative module 204A of the lower-most deck 202 and the upper-most deck 302 of the manifold assembly 200 supplies supply fluid of types 104 to the fluid-ejection printheads 102A and 102B of a representative pair 110A, according to an embodiment of the disclosure. The module 204A of the decks 202 and 302 is not actually depicted in FIGS. 4A and 4B for illustrative clarity. Rather, just how the fluid types 104 are encased within the module 204A of the decks 202 and 302 is depicted in FIGS. 4A and 4B so that it is easier to see the fluid types 104 in FIGS. 4A and 4B; that is, the fluid types 104 are shown in FIGS. 4A and 4B as if the modules 204A were present, but the modules 204A are not shown in FIGS. 4A and 4B for illustrative clarity. The reference numbers 204A, 202, and 302 in FIGS. 4A and 4B thus point to where the module 204A, the lower-most deck 202, and the upper-most deck 302 are located in relation to the fluid types 104.

The exterior-most fluid types 104A and 104D are therefore supplied by the module 204A of the lower-most deck 202 directly to the fluid-ejection printheads 102A and 102B in FIGS. 4A and 4B. By comparison, the interior-most fluid types 104B and 104C are supplied by the module 204A of the upper-most deck 302 to the fluid-ejection printheads 102A and 102B in FIGS. 4A and 4B, through the lower-most deck 202. As noted above, the exterior-most fluid types 104A and 104D and the interior-most fluid types 104B and 104C are defined as exterior-most and interior-most in relation to the direction 108. It is noted that FIG. 4B shows a direction 452 going away from the fluid-ejection printheads 102A and 102B, as will be described in more detail later in the detailed description.

Figure 5:
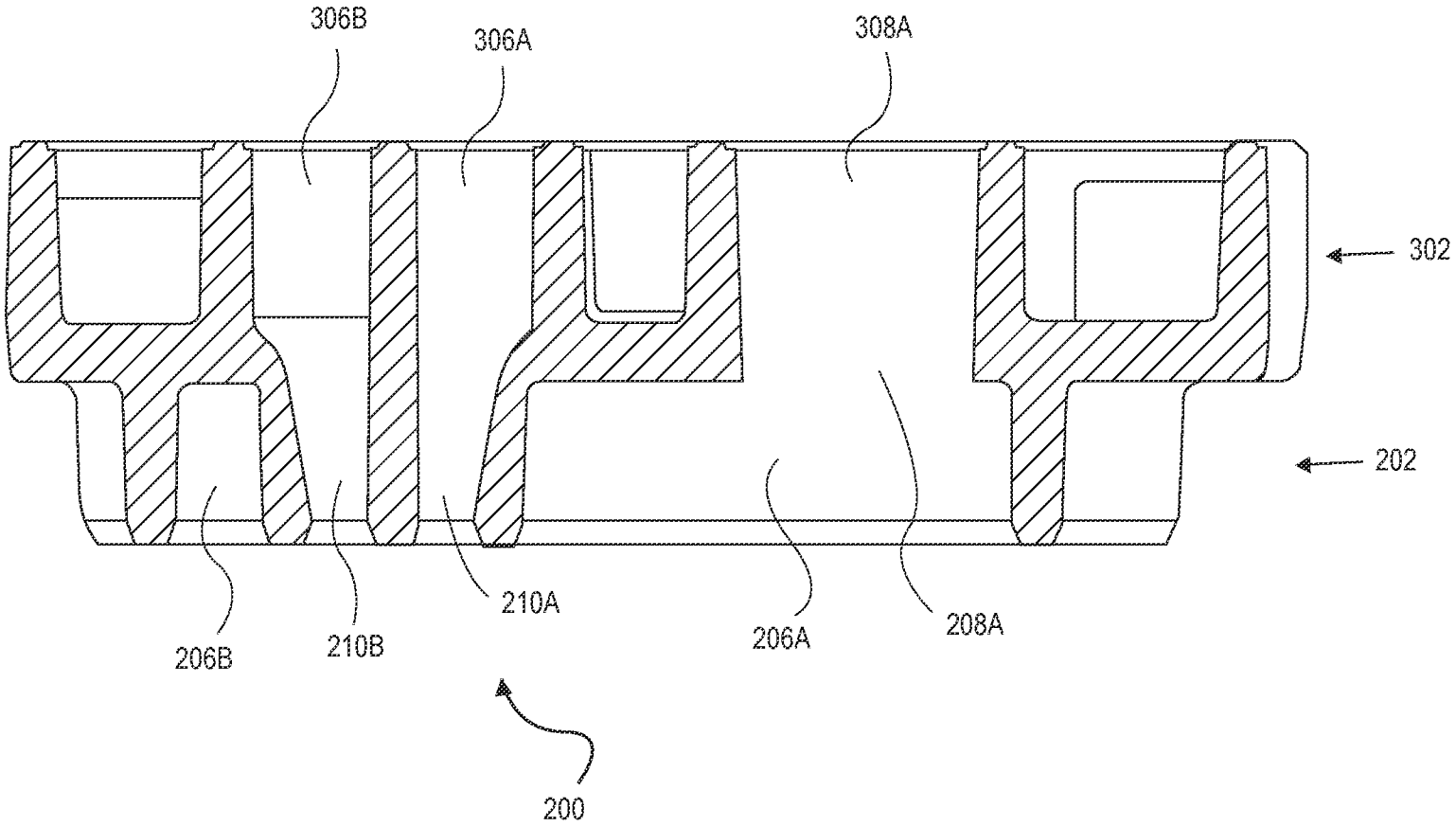
FIG. 5 is a cross-sectional diagram of a manifold assembly having a lower-most deck and an upper-most deck, according to an embodiment of the disclosure.

FIG. 5 shows a cross-section of the manifold assembly 200, including both the lower-most deck 202 and the upper-most deck 302, according to an embodiment of the disclosure. The lower-most deck 202 and the upper-most deck 302 can actually be fabricated as a single component as in FIG. 5, instead of being fabricated as two components that are then attached to one another. However, the manifold assembly 200 can be fabricated in either such way.

FIG. 5 shows how the hole 308A of the upper-most deck 302 is fluidically coupled to the channel 206A of the lower-most deck 202 via the hole 208A of the deck 202 so that the fluid type 104A can be supplied by the deck 202 from the deck 302. FIG. 5 further shows how the channel 306A of the upper-most deck 302 is fluidically coupled to the channel 210A of the lower-most deck 202 so that the fluid type 104B can be supplied by the deck 302 through the deck 202. Similarly, FIG. 5 shows how the channel 306B of the upper-most deck 302 is fluidically coupled to the channel 210B so that the fluid type 104C can be supplied by the deck 302 through the deck 202. In the cross-section of FIG. 5, just a portion of the channel 206B of the lower-most deck 202 can be seen, and the corresponding hole 208B of the deck 202 and the corresponding hole 308B of the upper-most deck 302 cannot be seen.

The manifold assembly 200 that has been described in relation to FIGS. 2-5 is advantageous in a number of ways. First, the fluid types 104 are delivered to the fluid-ejection printheads 102 using multiple decks 202 and 302. In this way, space to the left and right of the printheads 102 can be conserved by leveraging vertical space above the fluid-ejection printheads 102. As such, the manifold assembly 200 can be employed even when space is at a premium, due to the mechanism for advancing media past the fluid-ejection printheads 102 being positioned close to where the printheads 102 eject fluid onto the media.

It is noted in this respect that the manifold assembly 200 can be extended to supply more than four types 104 of fluid to the fluid-ejection printheads 102, by having more than two decks 202 and 302. One or more additional decks are situated between the lower-most deck 202 and the upper-most deck 302 in such scenarios. The lower-most deck 202 still supplies the exterior-most fluid types 104A and 104D, and the upper-most deck 302 still supplies the interior-most fluid types 104B and 104C. Other fluid types are supplied by one or more additional decks in accordance with the positioning of these other fluid types in relation to the exterior-most fluid types 104A and 104D and the interior-most fluid types 104B and 104C.

For example, consider a scenario in which eight fluid types 104 are supplied by the manifold assembly 200. A third deck is positioned between the decks 202 and 302 closer to the lower-most deck 202, and a fourth deck is positioned between the decks 202 and 302 closer to the upper-most deck 302. The third deck supplies the two fluid types 104 that are not the exterior-most fluid types 104A and 104D, but that are the next-most exterior fluid types 104. The fourth deck supplies the two fluid types 104 that are not the interior-most fluid types 104B and 104C, but that are the next-most interior fluid types 104.

Second, a reference module 204 of the lower-most deck 202 and the upper-most deck 302 is designed to balance the fluidic pressures within the reference module 204. Balancing the fluidic pressures within such a reference module 204 ensures that optimal ejection of the fluid by the fluid-ejection printheads 102 is not impaired. Once the reference module 204 has been so designed, the module 204 can be replicated as dictated by the width of the page-wide array of fluid-ejection devices 102. In this respect, different page-wide array widths can be easily constructed by simply replicating a suitable number of the modules 204 across the page-wide array in question. Balancing the fluidic pressures within each such module 204 can result in a symmetric relationship of the channels 206, 210, and 306 and the holes 208 and 308 of the decks 202 and 302 within each module 204, as is depicted in FIGS. 2-5.

Third, the channels 206 of the lower-most deck 202 and the channels 306 of the upper-most deck 302 have lengths that correspond to the lengths of the fluid-ejection printheads 102 themselves. That is, fluid is supplied from the channels 206 and the channels 306 across the entire lengths of the fluid-ejection printheads 102. This decreases the potential for fluidic pressure spikes occurring when fluid types 104 are supplied from the manifold assembly 200 to the printheads 102. Furthermore, supplying fluid across the entire lengths of the fluid-ejection printheads ensures that the individual fluid-ejection nozzles located across the lengths of the printheads are operating at the same pressure or at very close to the same pressure. Having the fluid-ejection nozzles operate at least substantially at the same pressure ensures that the fluid drops ejected by the nozzles are at least substantially identical in shape and in volume, which ensures optimal print quality where the fluid is ink and an image is being generated by the fluid-ejection printheads.

Fourth, as depicted in FIGS. 2-5, each of the channels 206, 210, and 306, and each of the holes 208 and 308 of the decks 202 and 302 of the manifold assembly 200 increase in size along at least one dimension in a direction going away from the fluid-ejection printheads 102. This direction is the direction 452 in FIG. 4B that was previously referenced. Such increases in size minimize the potential for bubbles of air or other gas to become trapped within the manifold assembly 200 during use. Over time, increasing amounts of air or other gas will likely enter the manifold assembly 200. As this occurs, the bubbles of this air or other gas will likely grow larger, and expand in the direction 452 of FIG. 4B, which is away from the fluid-ejection printheads 102. Bubble expansion in this direction ensures that the bubbles move away from the fluid-ejection printheads 102, preventing the bubbles from blocking the printheads 102. As such, the usable life of the fluid-ejection printheads 102 is increased.

Fifth, as also depicted in FIGS. 2-5, the fluid types 104 do not travel in a direction away from the fluid-ejection printheads 102 when being supplied to the printheads 102 by the decks 202 and 302 of the manifold assembly 200. This direction again is the direction 452 in FIG. 4B that was previously referenced. That is, from the upper-most deck 302 to the lower-most deck 202, the fluid types 104 do not travel "upstream" in the direction 452 away from the fluid-ejection printheads 102. This minimizes the potential for solid parts of the fluid of types 104, such as pigment of pigmented inks, from becoming lodged or collected within the manifold assembly 200.

Figure 6:
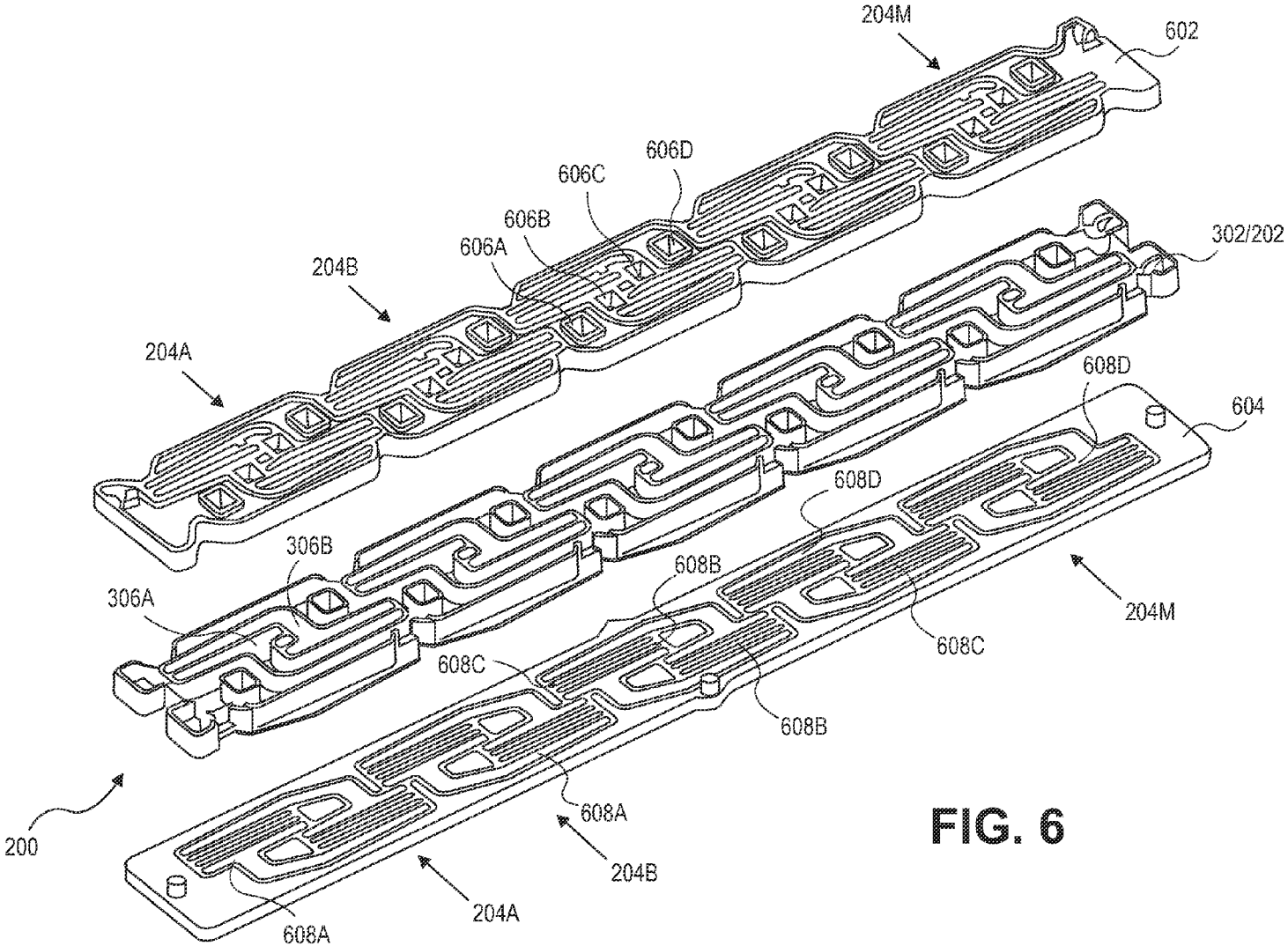
FIG. 6 is a diagram of a manifold assembly including top and bottom plates and lower-most and upper-most decks, according to an embodiment of the disclosure.
Figure 7:
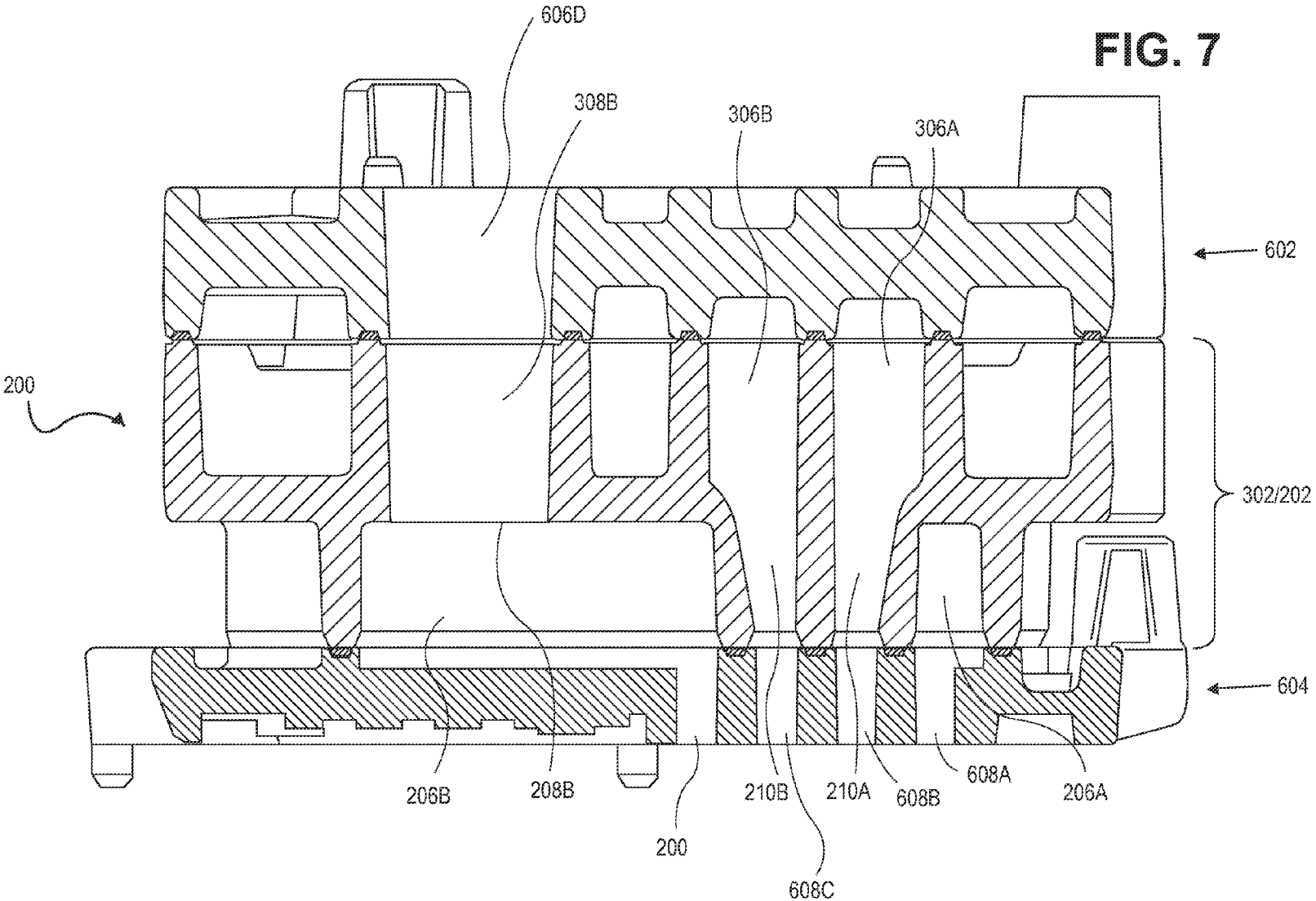
FIG. 7 is a cross-sectional diagram of a manifold assembly including top and bottom plates and lower-most and upper-most decks, according to an embodiment of the disclosure.

FIGS. 6 and 7 show the manifold assembly 200 as including a top plate 602 and a bottom plate 604 in addition to the decks 202 and 302, according to an embodiment of the disclosure. The plates 602 and 604 can be fabricated as components separate from the decks 202 and 302, and then joined to the decks 202 and 302 using an adhesive like epoxy, and/or via welding. The top plate 602 attaches to the top of the upper-most deck 302, and the bottom plate 604 attaches to the bottom of the lower-most deck 202. Like the decks 202 and 302, the top plate 602 and the bottom plate 604 are logically divided into modules 204A, 204B, . . . , 204M, collectively referred to as the modules 204, and which correspond to the fluid-ejection printhead pairs 110.

The top plate 602 fluidically connects supplies of the fluid types 104 to the decks 202 and 302. Each module 204 of the top plate 602 includes a hole 606A corresponding to the hole 308A of the upper-most deck 302 to deliver fluid type 104A through the deck 302 to the lower-most deck 202, and a hole 606D corresponding to the hole 308B of the upper-most deck 302 to deliver fluid type 104D through the deck 302 to the lower-most deck 202. Each module 204 of the top plate 602 also includes a hole 606B to deliver fluid type 104B to the channels 306A of the upper-most deck 302, and a hole 606C to deliver fluid type 104C to the channels 306B of the deck 302.

The bottom plate 604 provides for the fluid types 104 to be supplied to the fluid-ejection printheads from the decks 202 and 302. Each module 204 of the bottom plate 604 includes channels 608A corresponding to the channels 206A of the lower-most deck 202 so that the deck 202 delivers the fluid type 104A to the fluid-ejection printheads 102. Each module 204 of the bottom plate 604 similarly includes channels 608D corresponding to the channels 206B of the lower-most deck 202 so that the deck 202 delivers the fluid type 104D to the fluid-ejection printheads 102.

Each module 204 of the bottom plate 604 also includes channels 608B corresponding to the channels 306A of the upper-most deck 302 and to the channels 210A of the lower-most deck 202. As such, the upper-most deck 302 delivers the fluid type 104B to the fluid-ejection printheads 102 through the lower-most deck 202. Each module 204 of the bottom plate similarly includes channels 608C corresponding to the channels 306B of the upper-most deck 302 and to the channels 2108 of the lower-most deck 202. As such, the upper-most deck 302 delivers the fluid type 104C to the fluid-ejection printheads 102 through the lower-most deck 202.

Figure 8:
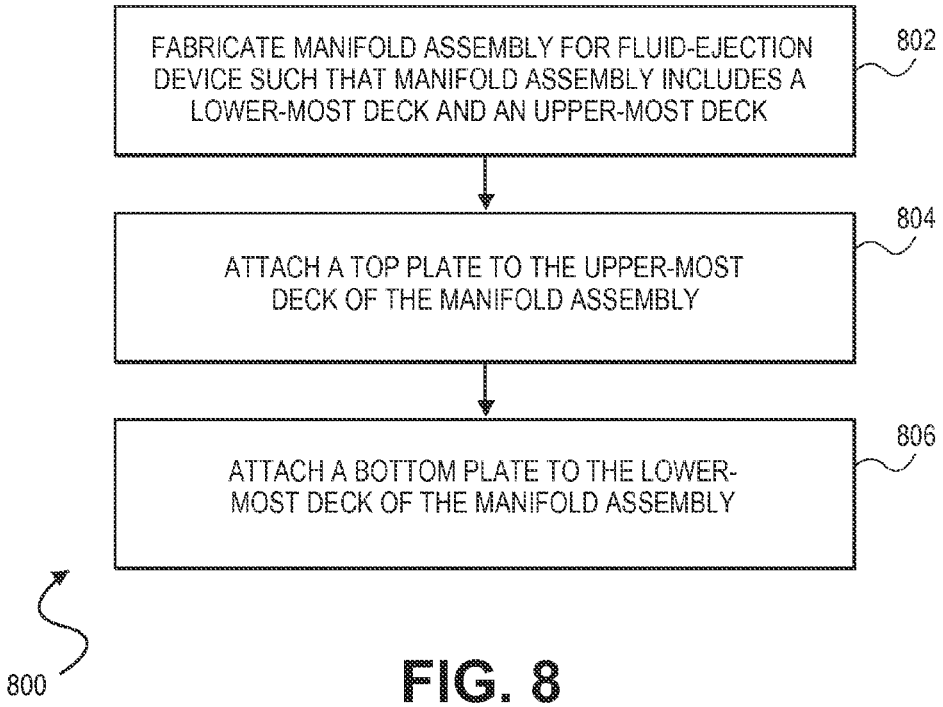
FIG. 8 is a flowchart of a method for manufacturing a manifold assembly, according to an embodiment of the disclosure.

FIG. 8 shows a method 800 for manufacturing the manifold assembly 200, according to an embodiment of the disclosure. The manifold assembly 200 is fabricated for the fluid-ejection device 100 so that the assembly 200 includes the lower-most deck 202 and the upper-most deck 302 (802). As noted above, the lower-most deck 202 and the upper-most deck 302 can be fabricated as a single component, such as by machining, cast injection, or by another approach. In another embodiment, the decks 202 and 302 may be fabricated as separate components that are then joined together.

The top plate 602 is fabricated and attached to the upper-most deck 302 of the manifold assembly 200 (804). Likewise, the bottom plate 604 is fabricated and attached to the lower-most deck 202 of the manifold assembly 200 (806). The plates 602 and 604 are manufactured as separate components from the decks 202 and 302, and can be fabricated in the same way as the decks 202 and 302 are. The plates 602 and 604 can be attached to their respective decks 302 and 202 via adhesive and/or welding, as has been noted above.

Figure 9:
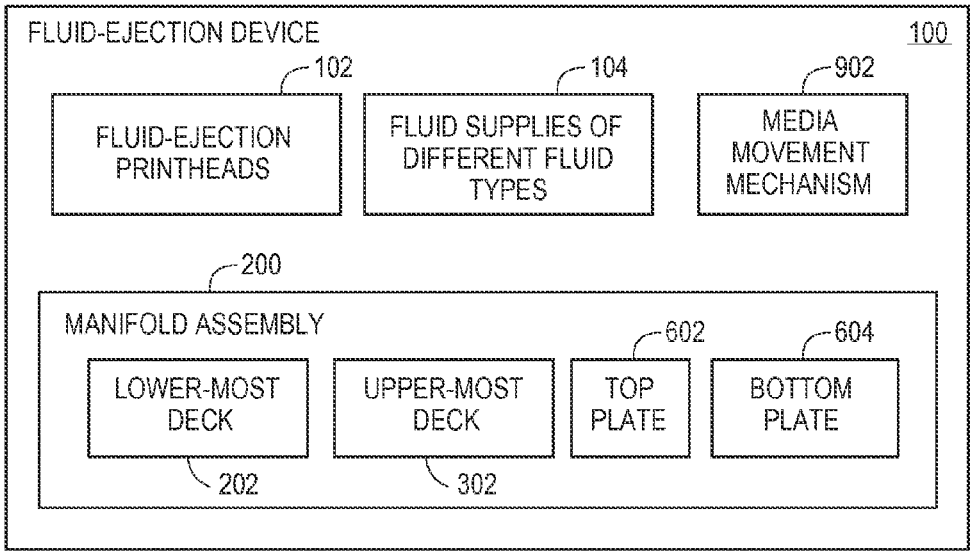
FIG. 9 is a block diagram of a fluid-ejection device including a manifold assembly, according to an embodiment of the disclosure.

In conclusion, FIG. 9 shows a block diagram of the fluid-ejection device 100, according to an embodiment of the disclosure. The fluid-ejection device 100 includes the fluid-ejection printheads 102, fluid supplies of different fluid types 104, a media movement mechanism 902, and the manifold assembly 200. The manifold assembly 200 itself includes the lower-most deck 202, the upper-most deck 302, the top plate 602, and the bottom plate 604.

The media movement mechanism 902 moves media, such as paper, past the fluid-ejection printheads 102. The fluid-ejection printheads 102 are organized as a page-wide array, and eject fluid onto the media as the media moves past the printheads 102. Each printhead 102 ejects fluid of different fluid types 104, as has been described above.

The fluid supplies of the different fluid types 104 are fluidically coupled to the top plate 602 of the manifold assembly 200. A filter housing and/or a back-pressure mechanism may be disposed between the top plate 602 and the fluid supplies of the different fluid types 104. The fluid-ejection printheads 102 are fluidically coupled to the bottom plate 604 of the manifold assembly 200. A spacer may be disposed between the bottom plate 604 and the fluid-ejection printheads 102.

It is noted that the fluid-ejection device 100 may be an inkjet-printing device, which is a device, such as a printer, that ejects ink onto media, such as paper, to form images, which can include text, on the media. The fluid-ejection device 100 is more generally a fluid-ejection, precision-dispensing device that precisely dispenses fluid, such as ink, melted wax, or polymers. The fluid-ejection device 100 may eject pigment-based ink, dye-based ink, another type of ink, or another type of fluid. Examples of other types of fluid include those having water-based or aqueous solvents, as well as those having non-water-based or non-aqueous solvents. However, any type of fluid-ejection, precision-dispensing device that dispenses a substantially liquid fluid may be used.

A fluid-ejection precision-dispensing device is therefore a drop-on-demand device in which printing, or dispensing, of the substantially liquid fluid in question is achieved by precisely printing or dispensing in accurately specified locations, with or without making a particular image on that which is being printed or dispensed on. The fluid-ejection precision-dispensing device precisely prints or dispenses a substantially liquid fluid in that the latter is not substantially or primarily composed of gases such as air. Examples of such substantially liquid fluids include inks in the case of inkjet-printing devices. Other examples of substantially liquid fluids thus include drugs, cellular products, organisms, fuel, and so on, which are not substantially or primarily composed of gases such as air and other types of gases.

We claim:

1. A manifold assembly for a fluid-ejection device having a plurality of multiple-fluid type fluid-ejection printheads organized in a page-wide array, comprising:

a lower-most deck to supply a first type of fluid and a second type of fluid to the fluid-ejection printheads, the first type of fluid and the second type of fluid being exterior-most fluids ejected by the fluid-ejection printheads in relation to a direction of media movement through the fluid-ejection device; and, an upper-most deck to supply at least one of a third type of fluid and a fourth type of fluid to the fluid-ejection printheads, the third type of fluid and the fourth type of fluid being interior-most fluids ejected by the fluid-ejection printheads in relation to the direction of media movement through the fluid ejection device, wherein each of the lower-most deck and the upper-most deck comprises a plurality of holes and a plurality of channels, and wherein at least one of:

one or more of the holes increase in size along at least one dimension in a direction away from the fluid-ejection printheads;

one or more of the channels increase in size along the at least one dimension in the direction away from the fluid-ejection printheads.

2. The manifold assembly of claim 1, wherein the lower-most deck and the upper-most deck are logically divisible into a plurality of modules organized along a direction perpendicular to the direction of media movement through the fluid-ejection device, each module to supply the first type of fluid, the second type of fluid, the third type of fluid, and the fourth type of fluid to a plurality of the fluid-ejection printheads, and each module being identical to every other module with respect to how the first type of fluid, the second type of fluid, the third type of fluid, and the fourth type of fluid are supplied.

3. The manifold assembly of claim 1, wherein the lower-most deck comprises a plurality of first channels having lengths corresponding to lengths of the fluid-ejection printheads to supply the first type of fluid across the lengths of the fluid-ejection printheads, wherein the lower-most deck comprises a plurality of second channels having lengths corresponding to the lengths of the fluid-ejection printheads to supply the second type of fluid across the lengths of the fluid-ejection printheads, wherein the upper-most deck comprises a plurality of third channels having lengths corresponding to the lengths of the fluid-ejection printheads to supply the third type of fluid across the lengths of the fluid-ejection printheads, and wherein the upper-most deck comprises a plurality of fourth channels having lengths corresponding to the lengths of the fluid-ejection printheads to supply the fourth type of fluid across the lengths of the fluid-ejection printheads.

4. The manifold assembly of claim 1, wherein each hole and each channel increases in size along the at least one dimension in the direction away from the fluid-ejection printheads.

5. The manifold assembly of claim 1, wherein the lower-most deck and the upper-most deck are such that the first type of fluid, the second type of fluid, the third type of fluid, and the fourth type of fluid each travel in a direction towards the fluid-ejection printheads when being supplied to the fluid-ejection printheads.

6. The manifold assembly of claim 1, wherein the lower-most deck comprises:

a plurality of first holes to receive the first type of fluid through the upper-most deck;

a plurality of first channels fluidically coupled to the first holes to supply the first type of fluid to the fluid-ejection printheads;

a plurality of second holes to receive the second type of fluid through the upper-most deck; and, a plurality of second channels fluidically coupled to the second holes to supply the second type of fluid to the fluid-ejection printheads.

7. The manifold assembly of claim 6, wherein the upper-most deck comprises:

a plurality of third channels to supply the third type of fluid to the fluid-ejection printheads through the lower-most deck; and, a plurality of fourth channels to supply the fourth type of fluid to the fluid-ejection printheads through the lower-most deck.

8. The manifold assembly of claim 1, further comprising:

a top plate to attach to a top of the upper-most deck, such that supplies of the first type of fluid, the second type of fluid, the third type of fluid, and the fourth type of fluid are fluidically connected to the upper-most deck and the lower-most deck via the top plate; and, a bottom plate to attach to a bottom of the lower-most deck, such that the first type of fluid, the second type of fluid, the third type of fluid, and the fourth type of fluid are supplied to the fluid-ejection printheads via the bottom plate.

9. A fluid-ejection device comprising:

a plurality of multiple-fluid type fluid-ejection printheads organized in a page-wide array; and, a manifold assembly comprising:

a lower-most deck to supply a first type of fluid and a second type of fluid to the fluid-ejection printheads, the first type of fluid and the second type of fluid being exterior-most fluids ejected by the fluid-ejection printheads in relation to a direction of media movement through the fluid-ejection device; and, an upper-most deck to supply a third type of fluid and a fourth type of fluid to the fluid-ejection printheads, the third type of fluid and the fourth type of fluid being interior-most fluids ejected by the fluid-ejection printheads in relation to the direction of media movement through the fluid ejection device, wherein each of the lower-most deck and the upper-most deck comprises a plurality of holes and a plurality of channels, and wherein at least one of:

one or more of the holes increase in size along at least one dimension in a direction away from the fluid-ejection printheads;

one or more of the channels increase in size along the at least one dimension in the direction away from the fluid-ejection printheads.

10. The fluid-ejection device of claim 9, wherein the lower-most deck and the upper-most deck are logically divisible into a plurality of modules organized along a direction perpendicular to the direction of media movement through the fluid-ejection device, each module to supply the first type of fluid, the second type of fluid, the third type of fluid, and the fourth type of fluid to a plurality of the fluid-ejection printheads, and each module being identical to every other module with respect to how the first type of fluid, the second type of fluid, the third type of fluid, and the fourth type of fluid are supplied.

11. The fluid-ejection device of claim 9, wherein the lower-most deck comprises a plurality of first channels having lengths corresponding to lengths of the fluid-ejection printheads to supply the first type of fluid across the lengths of the fluid-ejection printheads, wherein the lower-most deck comprises a plurality of second channels having lengths corresponding to the lengths of the fluid-ejection printheads to supply the second type of fluid across the lengths of the fluid-ejection printheads, wherein the upper-most deck comprises a plurality of third channels having lengths corresponding to the lengths of the fluid-ejection printheads to supply the third type of fluid across the lengths of the fluid-ejection printheads, and wherein the upper-most deck comprises a plurality of fourth channels having lengths corresponding to the lengths of the fluid-ejection printheads to supply the fourth type of fluid across the lengths of the fluid-ejection printheads.

12. The fluid-ejection device of claim 9, wherein each hole and each channel increases in size along the at least one dimension in the direction away from the fluid-ejection printheads.

13. The fluid-ejection device of claim 9, wherein the lower-most deck and the upper-most deck are such that the first type of fluid, the second type of fluid, the third type of fluid, and the fourth type of fluid each travel in a direction towards the fluid-ejection printheads when being supplied to the fluid-ejection printheads.

14. A method comprising:

fabricating a manifold assembly for a fluid-ejection device having a plurality of multiple-fluid type fluid-ejection printheads organized in a page-wide array, so that the manifold assembly comprises a lower-most deck and an upper-most deck, wherein the lower-most deck is to supply a first type of fluid and a second type of fluid to the fluid-ejection printheads, the first type of fluid and the second type of fluid being exterior-most fluids ejected by the fluid-ejection printheads in relation to a direction of media movement through the fluid-ejection device, wherein the upper-most deck is to supply a third type of fluid and a fourth type of fluid to the fluid-ejection printheads, the third type of fluid and the fourth type of fluid being interior-most fluids ejected by the fluid-ejection printheads in relation to the direction of media movement through the fluid ejection device, wherein the manifold assembly is fabricated such that each of the lower-most deck and the upper-most deck comprises a plurality of holes and a plurality of channels, and wherein the manifold assembly is fabricated such that at least one of:

one or more of the holes increase in size along at least one dimension in a direction away from the fluid-ejection printheads;

one or more of the channels increase in size along the at least one dimension in the direction away from the fluid-ejection printheads.

15. The method of claim 14, further comprising:

attaching a top plate to a top of the upper-most deck, such that supplies of the first type of fluid, the second type of fluid, the third type of fluid, and the fourth type of fluid are fluidically connected to the upper-most deck and the lower-most deck via the top plate; and, attaching a bottom plate to a bottom of the lower-most deck, such that the first type of fluid, the second type of fluid, the third type of fluid, and the fourth type of fluid are supplied to the fluid-ejection printheads via the bottom plate.

* * * * *